United States Patent [19]

Keyser et al.

[11] 4,036,581

[45] July 19, 1977

[54] IGNITER

[75] Inventors: David R. Keyser, Churchville; Pierce H. Zavod, King of Prussia, both of Pa.

[73] Assignee: The United States of America as represented by the Secretary of the Navy, Washington, D.C.

[21] Appl. No.: 720,310

[22] Filed: Sept. 3, 1976

[51] Int. Cl.[2] ..... F23Q 1/00

[52] U.S. Cl. ..... 431/267; 102/81; 110/1 F; 431/2

[58] Field of Search ..... 431/1, 2, 258, 267; 102/81, 70 R, 70.2, 27 F; 110/1 F

[56] References Cited

U.S. PATENT DOCUMENTS

| | | | |
|---|---|---|---|
| 3,240,254 | 3/1966 | Hughes | 431/1 X |
| 3,333,619 | 8/1967 | Denis | 431/1 X |
| 3,863,571 | 2/1975 | Campagnuolo | 102/81 |
| 3,974,773 | 8/1976 | Rongus | 102/81 |

*Primary Examiner*—Edward G. Favors

*Attorney, Agent, or Firm*—R. S. Sciascia; Henry Hansen

[57] ABSTRACT

An igniter for fuel oil sprays. A plurality of fluidic oscillator or resonance tubes are distributed about a central oscillator opening into one end of a closed chamber. One or more nozzles are located in an end of the chamber opposite the tubes. Compressed gas, such as air, is injected at high velocity from the nozzles into the tubes. The kinetic energy of the gas due to alternating in-and-out flow in the tubes is dissipated as heat transferred to the outer surfaces thereof. When fuel spray impinges on the hot outer surfaces of the tubes, ignition results. The central tube is wrapped with a high temperature resistant cloth. Impinging fuel is soaked into the cloth and vaporized as it is heated.

6 Claims, 6 Drawing Figures

IGNITER

STATEMENT OF GOVERNMENT INTEREST

The invention described herein may be manufactured and used by or for the Government of the U.S. of America for governmental purposes without the payment of any royalties thereon or therefor.

BACKGROUND OF THE INVENTION

The present invention relates to heating elements, and more particularly to igniters for fuel burners.

With fuel burners such as used in marine boilers, it has been the general practice to light off or ignite such burners by having a man extend a torch through a door into the boiler while fuel is being fed in. In addition to requiring a knowledgeable operator, this method is dangerous in that, upon ignition of the fuel, there can be a flareback or burst of flame out from the burner through the open door, injuring the operator.

An alternative method of lighting the burner is by means of an electric arc. However, the arc requires high voltage electricity which itself constitutes a hazard. Also, the arc generates electrical interference which can hamper operation of nearby communications and other electrical equipment, as well as interfering with radio communications. In addition, the arc method may be unreliable and difficult to maintain in that buildup of carbon, soot or other waste can prevent the arc from operating. Humidity can cause current leakage through the air particularly in high voltage situations. Short circuits from damaged wire insulation and from other causes can prevent formation of the arc. In addition, an electric arc igniter requires a separate power supply with accompanying operation and maintenance problems. If this power supply is not kept operating and available for use at all times, then in the event of any burner shut down, startup of the burner would be delayed until the power supply was readied. Such a situation would be especially disadvantageous where other systems are powered from and depend upon the fuel burner, such as is the situation on board a ship.

SUMMARY OF THE INVENTION

Accordingly, it is a general purpose of the present invention to provide an igniter capable of lighting fuel sprays and fuel burners producing such sprays when supplied fuel while unlit.

Other objects of the present invention are to provide an igniter which is safe, easy to use, automatic, and free of flareback.

Further objects of the present invention are to provide an igniter which is reliable, is easily maintained, and is free of electrical noise and interference.

Briefly, these and other objects of the invention are accomplished by means of an igniter which includes a plurality of fluidic oscillators, or resonance tubes, which are arranged in a regular array about a central oscillator. The central oscillator includes an absorbent material. The oscillators are mounted on one end of a shroud which encloses a chamber or plenum. The oscillators are each closed at one end; their open ends open into the chamber. One or more nozzles positioned opposite the oscillators are formed in a manifold located at the opposite end of the chamber. The manifold is connected to a supply of pressurized gas such as air. The gas is injected at high velocity from the nozzles to the oscillators, resulting in an alternating in-and-out flow, with compression and expansion flow oscillations, in the oscillators. Some of the kinetic energy of the gas due to this flow is dissipated as heat which is transferred to the outer surfaces of the oscillators. The shroud is provided with a plurality of discharge orifices which permit pressure relief within the shroud. For ignition, the igniter is placed near the burner to be lit, so that fuel spray from the burner will impinge upon the igniter. The igniter is then heated by gas flow. Fuel is then supplied to the burner, from which it issues as a spray. The oscillators surrounding the central oscillator transfer heat into the central oscillator, preheat and vaporize incoming fuel spray, and prevent or reduce loss of heat from the central oscillator by radiation. Fuel spray from the burner impinging on the absorbent material of the central oscillator is soaked into that material and is vaporized as it is heated. When the fuel vapors are sufficiently heated by the oscillators, they ignite, resulting in lighting of the burner. The igniter can be extended for ignition or retracted when not in use by a pneumatic or other type of cylinder.

Other objects, advantages, and novel features of the invention will become apparent from the following detailed description of the invention when considered in conjunction with the accompanying drawings wherein:

DESCRIPTION OF THE PREFERRED EMBODIMENTS

Figure 1:
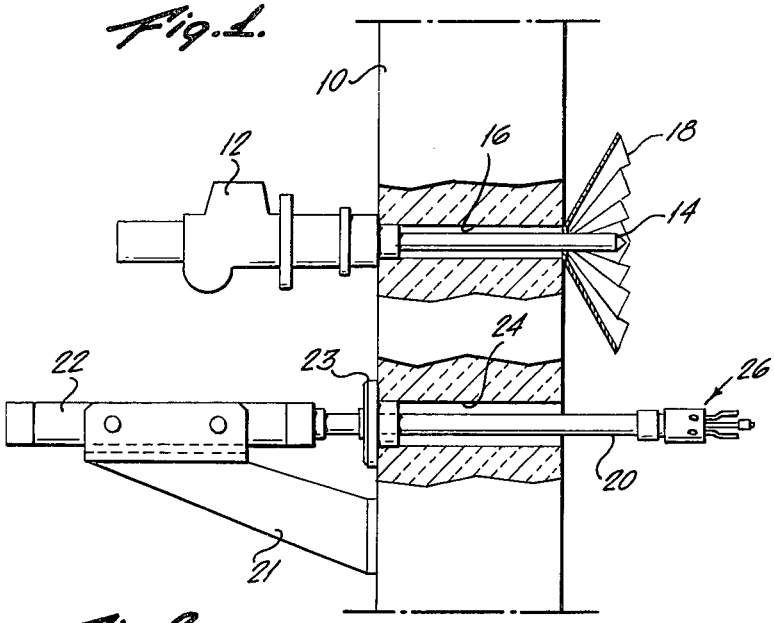
FIG. 1 shows a side elevation of a fuel burner and a preferred embodiment of an igniter according to the present invention installed in a furnace wall.

Referring now to the drawings, wherein like reference characters designate like or corresponding parts throughout the several views, there is shown in FIG. 1 a furnace wall 10 on which is mounted a conventional fuel burner 12, which can, for example, be an oil burner, extending through hole 16 in wall 10 to form a nozzle 14. Placed about nozzle 14 is a diffuser plate 18 which acts to distribute the flow of air in the furnace about nozzle 14, deflecting some air around the nozzle, while other air passes through openings in the plate to move about the nozzle in a swirling fashion, as is well known in the burner art. Igniter 26 is positioned below, adjacent to and forward of nozzle 14 and plate 18 when used to ignite burner 12. Igniter 26 can be extended for ignition, or withdrawn after used, on supply line 20 through opening 24 and wall 10, by a pneumatic or other type of cylinder 22. Cylinder 22, which is supported on wall 10 by bracket 21, extends and retracts igniter 26 through plate 23 and hole or opening 24 by supply line 20. If cylinder 22 is a pneumatic cylinder, it can be powered from the same pressurized gas supply used with igniter 26.

Figure 3:
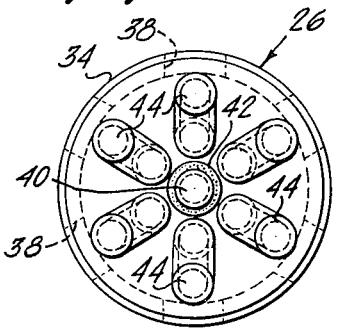
FIG. 3 is an end view of the igniter of FIG. 2 taken along the line 3—3.
Figure 2:
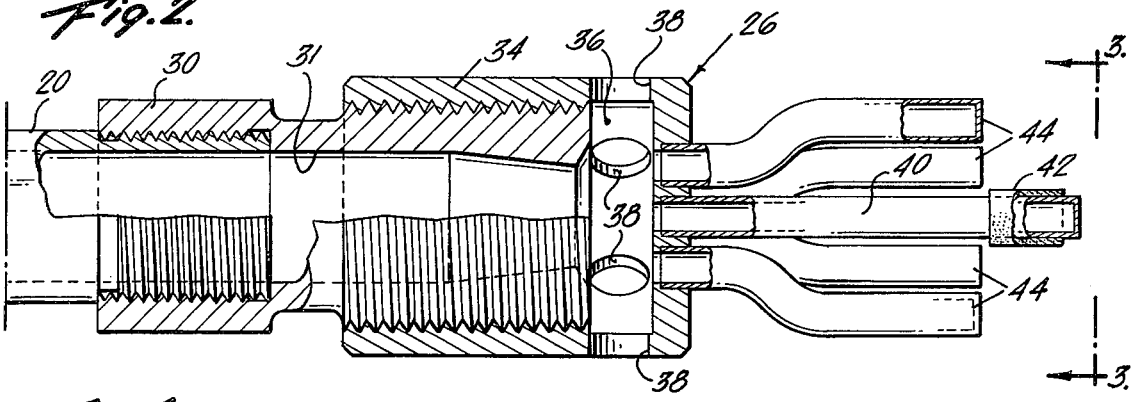
FIG. 2 is the igniter of FIG. 1 shown in a side view with portions cut away.

As shown in FIGS. 2-3, the embodiment of igniter 26 shown in FIG. 1 includes a manifold 30 threadingly engaging supply line 20. Manifold 30 has a converging-diverging nozzle 31 for accelerating fluid flow therethrough and to cause the flow to be substantially unidirectional. Manifold 30 also threadingly engages shroud 34, forming chamber or plenum 36 between shroud 34 and manifold 30. Shroud 34 has a plurality of discharge orifices 38. Mounted at the end of shroud 34 opposite manifold 30 is a principal igniter or central fluidic oscillator 40 surrounded by an array or cluster of fluidic oscillators 44. Oscillators 40 and 44 are resonance tubes, each having an open end or mouth opening into chamber 36 and an opposite closed end distant from shroud 34. Central oscillator 40 is slightly longer than oscillators 44 and is covered near its closed end with an absorbent sleeve 42 of high-temperature resistant material such as asbestos. Oscillators 40 and 44 may be constructed of high temperature metals, or of porous material such as a glass ceramic. The mouths of oscillators 44 are arranged closely about the mouth of oscillator 40 so as to be opposite the opening of nozzle 31, and oscillators 44 are curved outwardly from central oscillator 40 to increase their spacing therefrom in order to increase the portion of the fuel spray which they heat.

The operation of igniter 26 is as follows. After igniter 26 has been extended through wall 10 to the position shown in FIG. 1 opposite burner 12, pressurized gas such as air is supplied to manifold 30 via supply lie 20. The pressurized gas exits the nozzle 31 and moves across chamber 36 to the mouths of oscillators 40 and 44 opposite the nozzle. The flow of the pressurized gas sets up a shock wave at the mouths of oscillators 40 and 44, which causes resonant alternatinng inflow and outflow, compression and expansion flow oscillations in oscillators 40 and 44. Some of the kinetic energy from these oscillations is dissipated in the form of heat which is transferred to the outer surfaces, particularly the closed tips, of oscillators 40 and 44. This heating effect is more fully explained in U.S. Pat. Nos. 3,630,151 and 3,863,571 to Edward L. Rakowsky and Carl J. Campagnuolo et al, respectively; and in Smith, T. and Powell, A., *Experiments Concerning the Hartmann Whistle,* U.C.L.A. Report No. 64–42, 1964 (NTIS Accession No. AD-608808). After igniter 26 has been allowed to heat up, fuel is supplied to burner 12 so that a spray of fuel emanates from nozzle 14. Some of this spray falls upon igniter 26. Oscillators 44 heat and vaporize some of this spray. Oscillators 44 also set up a thermal barrier to reduce radiation heat loss from oscillator 40, and further serve to heat central oscillator 40. Central oscillator 40 is slightly longer than the surrounding oscillators 44 to expose sleeve 42 to the fuel spray. Sleeve 42 absorbs fuel from the spray which is then evaporated by heat from oscillator 40, for easier fuel evaporation and improved fuel vapor density around the tip of the central oscillator 30. If oscillator 40 is constructed of porous material which can contact and absorb impinging fuel, instead of using sleeve 42, a similar effect will result. Central oscillator 40 is thus surrounded by heated air and fuel vapors, thus reducing the heating of oscillator 40 required to accomplish combustion of a fuel spray. When the vapors are sufficiently heated, they ignite, and the resulting flame spreads to the whole of the impinging fuel spray, thus lighting burner 12. Orifices 38 permit escape of gas from chamber 36, thus accomplishing pressure relief. Once ignition occurs, igniter 26 and supply line 20 can be withdrawn by cylinder 22 through wall 10 and plate 23.

Figure 4:
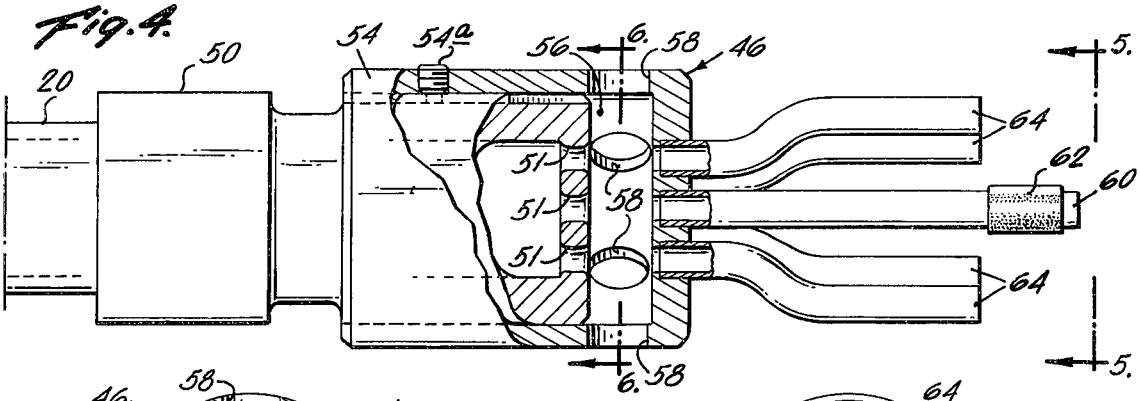
FIG. 4 is a side view of another preferred embodiment of an igniter according to the present invention with portions cut away.
Figure 6:
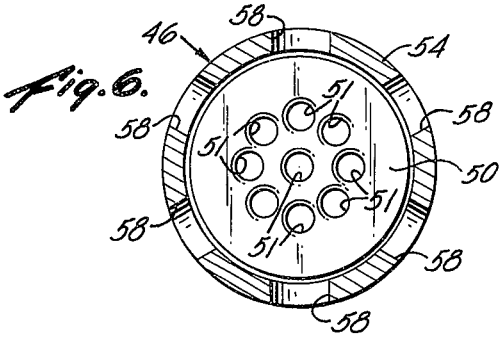
FIG. 6 is a section of the igniter of FIG. 4 taken along the line 6—6.
Figure 5:
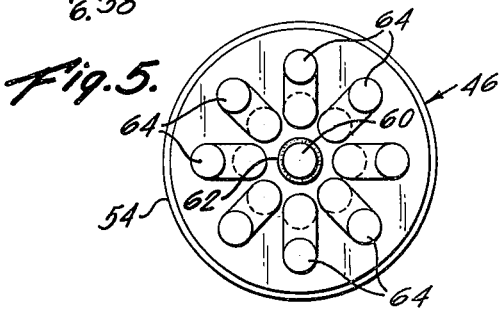
FIG. 5 is an end view of the igniter of FIG. 4 taken along the line 5—5.

There is shown in FIGS. 4–6 an alternative igniter 46 which can be used in place of igniter 26 in the arrangement of FIG. 1. Igniter 46 has a manifold 50 attached to supply line 20. Manifold 50 is also attached to shroud 54 with set screw 54a, although other means can be used to attach manifold 50 to shroud 54 and to hold it in place. The space between manifold 50 and shroud 54 defines a chamber or plenum 56 having a plurality of discharge orifices 58. A central fluidic oscillator 60 is mounted on the end of shroud 54 opposite manifold 50. Central oscillator 60 is surrounded by an array or cluster of fluidic oscillators 64 which are mounted on the end of shroud 54 opposite manifold 50. Oscillators 60 and 64 are resonance tubes, each having an open end or mouth opening into chamber 56 and on opposite closed end distant from shroud 54. Central oscillator 60 is covered near its closed end with an absorbent sleeve 62 of high-temperature resistant material such as asbestos. Central oscillator 60 is slightly longer than oscillators 64 so that sleeve 62 is exposed. Oscillators 60 and 64 may be constructed of high temperature metals, or of porous material such as glass ceramic. The end of manifold 50 facing chamber 56 is provided with a plurality of orifices or nozzles 51 positioned directly opposite the mouths of oscillators 60 and 64.

The operation of igniter 46 is the same as the operation of igniter 26, except that the plurality of orifices 51 produce a plurality of gas flows, one toward each mouth of oscillators 60 and 64.

It should be understood that, for greater heating, the central oscillator can be surrounded with a series of concentric circles or other arrays of other oscillators, instead of a single circle or other array. For example, if the central oscillator is surrounded with six other oscillators in a hexagonal array centered about the central oscillator, those six oscillators can be surrounded with twelve more oscillators arranged outside the six oscillators in a hexagonal array also centered at the central oscillator. As a further example, if the central oscillator is surrounded by four other oscillators regularly arranged on a circle centered about the central oscillator, that circle of oscillators can be surrounded by another regular circular array, centered about the central oscillator, of four or eight additional oscillators. Also, where the manifold is provided with a plurality of openings for driving the oscillators, the oscillators surrounding the central oscillator can be straight or curved inward instead of curved outward, their mouths can be spaced further apart, and the manifold openings can be similarly spaced further apart, to reduce the possibility of the pressurized gas flow from one of the manifold openings interfering with the flow from another opening. In addition, the shroud can be connected to the manifold, and the manifold to the supply line, by soldering, welding, one or more set screws, or by providing the parts to be joined with screw threads so that the parts can threadingly engage, or by any other suitable means.

Thus there has been provided a novel igniter capable of igniting fuel sprays and fuel burners producing such sprays when being supplied fuel while unlit. This igniter can be operated automatically from a control panel. The igniter is safe and easy to use, and is free of flareback. Also, the igniter is reliable and is easily maintained. In addition, the igniter is free of generate electrical noise or interference. Furthermore, use of a plurality of manifold nozzles or orifices instead of one single nozzle or orifice provides greater efficiency in that the amount of gas leaving the manifold is reduced. However, use of a single nozzle or orifice avoids the need for aligning the orientation of a plurality of nozzles with the respective oscillators.

Obviously, many modifications and variations of the present invention are possible in light of the above teachings. It is therefore to be understood that within the scope of the appended claims the invention may be practiced otherwise than as specifically described.

What is claimed is:

1. An igniter, comprising:

a manifold, adapted to receive pressurized gas, provided with a nozzle adapted to pass the gas therethrough;

a chamber connected to said manifold and provided with a plurality of orifices;

a first hollow tube, centrally mounted on said chamber opposite the nozzle, having a closed end and an open end forming a resonant cavity, the closed end being distant from said chamber and the open end opening into said chamber and being adapted to receive the gas from the nozzle; and a cluster of second hollow tubes, arranged about said first hollow tube, mounted on said chamber opposite the nozzle, each of said second tubes having a closed end and an open end forming a resonant cavity, the closed end being distant from said chamber and the open end opening into said chamber and being adapted to receive the gas from the nozzle.

2. An igniter as defined in claim 1 wherein said manifold comprises:

a plurality of nozzles positioned opposite the open ends of said first and cluster of second tubes.

3. An igniter as defined in claim 1, further comprising: an absorbent coating disposed on said first tube.

4. An igniter as defined in claim 3, wherein said coating comprises a sleeve.

5. An igniter as defined in claim 1, wherein said first tube is constructed of porous material.

6. An igniter as defined in claim 5, wherein said cluster of second tubes are constructed of porous material.

* * * * *